US009052081B1

(12) United States Patent
Paulsel

(10) Patent No.: US 9,052,081 B1
(45) Date of Patent: Jun. 9, 2015

(54) MAGNETIC DOWNLIGHT WALL-WASH KICKER

(75) Inventor: Jason Q. Paulsel, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 160 days.

(21) Appl. No.: 13/464,096

(22) Filed: May 4, 2012

(51) Int. Cl.

| | |
|---|---|
| ***F21V 7/00*** | (2006.01) |
| ***F21V 17/00*** | (2006.01) |
| ***F21V 21/096*** | (2006.01) |
| *F21S 8/02* | (2006.01) |
| *F21V 21/04* | (2006.01) |

(52) U.S. Cl.
CPC .... *F21V 7/00* (2013.01); *F21S 8/02* (2013.01); *F21V 17/00* (2013.01); *F21V 21/096* (2013.01); *F21V 21/04* (2013.01); *F21V 21/046* (2013.01); *F21S 8/026* (2013.01)

(58) Field of Classification Search
CPC ..... F21V 7/00; F21V 7/0008; F21V 7/0016; F21V 7/22; F21V 14/006; F21V 14/04; F21V 14/045; F21V 21/02; F21V 21/03; F21V 21/08; F21V 21/096; F21V 21/0965
USPC ..... 362/296, 306, 341, 347, 350, 364, 408, 362/398
See application file for complete search history.

(56) References Cited

U.S. PATENT DOCUMENTS

| | | | | | |
|---|---|---|---|---|---|
| 4,475,147 | A * | 10/1984 | Kristofek | 362/148 |
| 5,967,640 | A * | 10/1999 | Moriyama et al. | 362/147 |
| RE36,908 | E * | 10/2000 | Ling | 362/297 |
| 6,502,965 | B1 * | 1/2003 | Bradford | 362/346 |
| 2005/0265016 | A1 * | 12/2005 | Rappaport | 362/147 |
| 2006/0221620 | A1 * | 10/2006 | Thomas | 362/364 |
| 2008/0266851 | A1 * | 10/2008 | Engel | 362/240 |
| 2010/0259919 | A1 * | 10/2010 | Khazi et al. | 362/84 |
| 2011/0267827 | A1 * | 11/2011 | Wein | 362/368 |
| 2013/0163254 | A1 * | 6/2013 | Chang et al. | 362/294 |

FOREIGN PATENT DOCUMENTS

| | | | | |
|---|---|---|---|---|
| DE | 4202295 | * | 7/1993 | F21S 8/02 |

* cited by examiner

*Primary Examiner* — Jong-Suk (James) Lee
*Assistant Examiner* — Zheng Song
(74) *Attorney, Agent, or Firm* — King & Spalding LLP

(57) ABSTRACT

A magnetic kicker reflector that is installed within a reflector of a downlight fixture to create a "wall-wash" effect on one or more adjacent walls. The magnetic kicker reflector includes a proximal end, a distal end, a side surface extending from the proximal end to the distal end, and one or more magnets. The side surface includes an internal surface and an external surface. The magnets are coupled to or adjacent the external surface and faces substantially the same direction as the external surface. The proximal end, the distal end, and the side surface are formed having an arcuate length. The wall-wash assembly includes the kicker reflector, a reflector, and one or more bands coupled around and in contact with the outer surface of the reflector. The bands are in alignment with the magnets so that the kicker reflector is rotatable within the reflector and maintains attraction to the bands.

16 Claims, 7 Drawing Sheets

700
LED
Upper Reflector
Curved Lens
Wall Wash Kicker
Reflected Rays
735
730
732
710
736
738
739
740
737
132
110
130
170
765
710
Room
Wall

MAGNETIC DOWNLIGHT WALL-WASH KICKER

TECHNICAL FIELD

The present invention relates generally to lighting fixtures and more particularly, to downlight wall-wash lighting fixtures installed within a ceiling that illuminate a surface area on an adjacent wall, where the surface area extends from the floor to essentially the intersection between the ceiling and the adjacent wall.

BACKGROUND

Downlight wall-wash lighting fixtures are designed to be installed within a ceiling close to an adjacent vertical surface, or adjacent wall. The downlight wall-wash lighting fixture projects light onto a surface area of the adjacent wall, where the surface area extends from the floor to essentially the intersection between the adjacent wall and the ceiling. Since the lamp within the fixture is typically recessed in the ceiling, the light emitted from the lamp is directed downwardly and outwardly at an angle towards the adjacent wall.

Conventional downlight wall-wash lighting fixtures achieve the "wall-wash" effect by using a distinct kicker reflector, a separate lamp reflector that surrounds the lamp, and a lens. Conventional downlight wall-wash lighting fixtures are designed to provide a "wall-washing" effect on a desired adjacent wall once installed within the ceiling. These conventional fixtures require proper alignment within the ceiling in relation to the adjacent wall so that the proper "wall-wash" effect is achieved on the adjacent wall.

Sometimes these conventional downlight wall-wash lighting fixtures are placed adjacent to two or more adjacent walls, but are installed so that it provides the "wall-washing" effect on only one of the two adjacent walls. According to some conventional downlight wall-wash lighting fixtures, if the user decides to provide "wall-washing" effects on the other adjacent wall and not the previously selected adjacent wall, the user has to remove the conventional downlight wall-wash lighting fixture, rotate it, and re-install the conventional downlight wall-wash lighting fixture. Thus, these conventional downlight wall-wash lighting fixtures do not provide flexibility, thereby adding extra time and costs for moving the "wall-washing" effects from one adjacent wall onto another adjacent wall. Additionally, the user is not able to provide "wall-washing" effects to both adjacent walls simultaneously without replacing the previously installed fixture.

However, according to some conventional downlight wall-wash lighting fixtures, the distinct kicker reflector, the separate lamp reflector that surrounds the lamp, and the lens form a rotatable wall-wash module. In these conventional downlight wall-wash lighting fixtures, if the user decides to provide "wall-washing" effects on the other adjacent wall and not the previously selected adjacent wall, the user has to rotate the entire rotatable wall-wash module within the fixture's housing to direct the "wall-washing" effects onto the adjacent wall. Manufacturing costs are increased when providing capabilities to allow the entire wall-wash module to rotate. Additionally, the user is not able to provide "wall-washing" effects to both adjacent walls simultaneously without replacing the previously installed fixture.

SUMMARY

One embodiment of the present invention includes a magnetic kicker reflector. The magnetic kicker reflector can include a proximal end, a distal end, a side surface extending from the proximal end to the distal end, and one or more magnets. The side surface can include an internal surface and an opposing external surface. The magnets can be coupled to or adjacent the external surface and facing substantially the same direction as the external surface. The contour of the internal surface can be different than the contour of the external surface. The proximal end, the distal end, and the side surface can include an arcuate curve length.

Another embodiment of the present invention includes a wall-wash assembly. The wall-wash assembly can include a reflector, at least one band, and at least one magnetic kicker reflector. The reflector can include a proximal end, a distal end, and a side surface extending from the proximal end to the distal end. The proximal end can form a proximal opening. The distal end can form a distal opening. The side surface can include an internal surface and an opposing external surface. The bands can be disposed about and can be in contact with the external surface. The bands can extend around the circumference of at least a portion of the external surface. The magnetic kicker reflector can be disposed within the reflector and can be positioned adjacent to at least a portion of the internal surface. The magnetic kicker reflector can include a kicker proximal end, a kicker distal end, a kicker side surface extending from the kicker proximal end to the kicker distal end, and one or more magnets. The kicker side surface can include a kicker internal surface and an opposing kicker external surface. The magnets can be coupled to or adjacent the kicker external surface and in contact with the internal surface of the reflector. The contour of the kicker internal surface can be different than the contour of the internal surface of the reflector. The kicker proximal end, the kicker distal end, and the kicker side surface can include an arcuate curve length.

Another embodiment of the present invention includes a wall-wash kit assembly. The wall-wash kit assembly can include a magnetic kicker reflector and one or more magnets. The magnetic kicker reflector can include a proximal end, a distal end, and a side surface extending from the proximal end to the distal end. The side surface can include an internal surface and an opposing external surface. The magnets can be coupled to or adjacent the external surface and can be facing substantially the same direction as the external surface. The proximal end, the distal end, and the side surface can include an arcuate curve length.

BRIEF DESCRIPTION OF THE DRAWINGS

The foregoing and other features and aspects of the invention are best understood with reference to the following description of certain exemplary embodiments, when read in conjunction with the accompanying drawings, wherein:

FIG. 1 is a perspective view of a wall-wash assembly in accordance with an exemplary embodiment of the present invention;

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to downlight wall-wash lighting fixtures installed within a ceiling that illuminate a surface area on an adjacent wall, where the surface area extends from the floor to essentially the intersection between the ceiling and the adjacent wall. Although the description of exemplary embodiments is provided below in conjunction with a light emitting diode ("LED"), or LED package, light source, alternate embodiments of the invention may be applicable to other types of lamps including, but not limited to, high intensity discharge ("HID") lamps, incandescent lamps, fluorescent lamps, compact fluorescent lamps, organic light emitting diodes, or a combination of lamp types known to persons having ordinary skill in the art.

Figure 2:
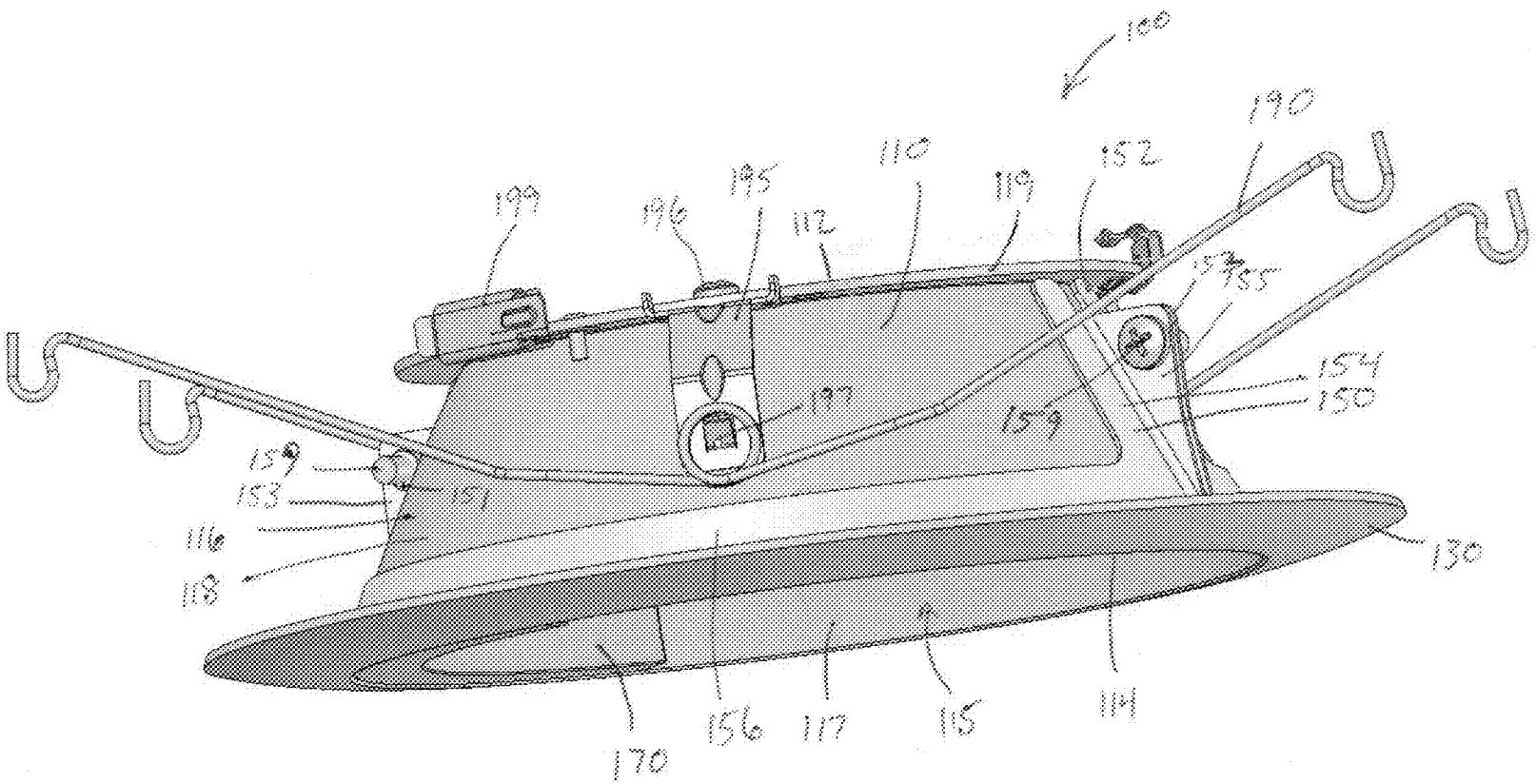
FIG. 2 is a top view of the wall-wash assembly of FIG. 1 in accordance with an exemplary embodiment of the present invention.
Figure 2:
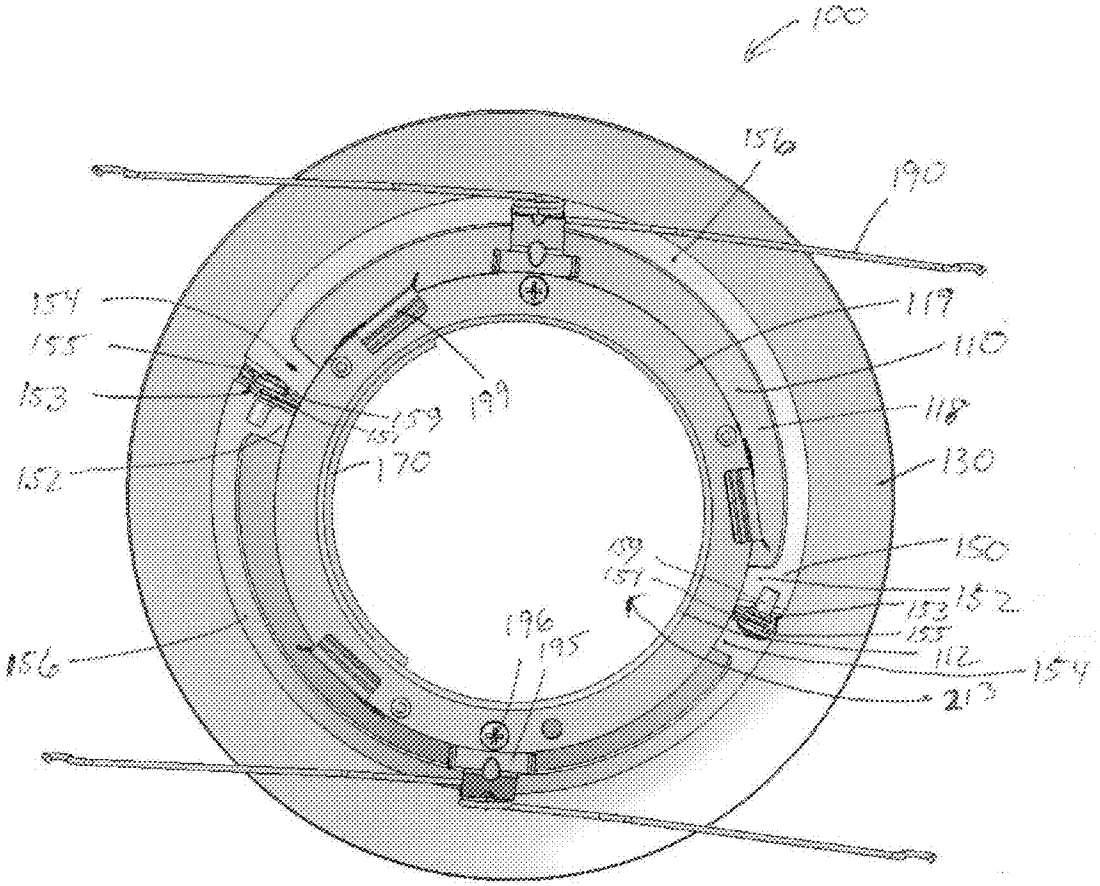
Figure 3:
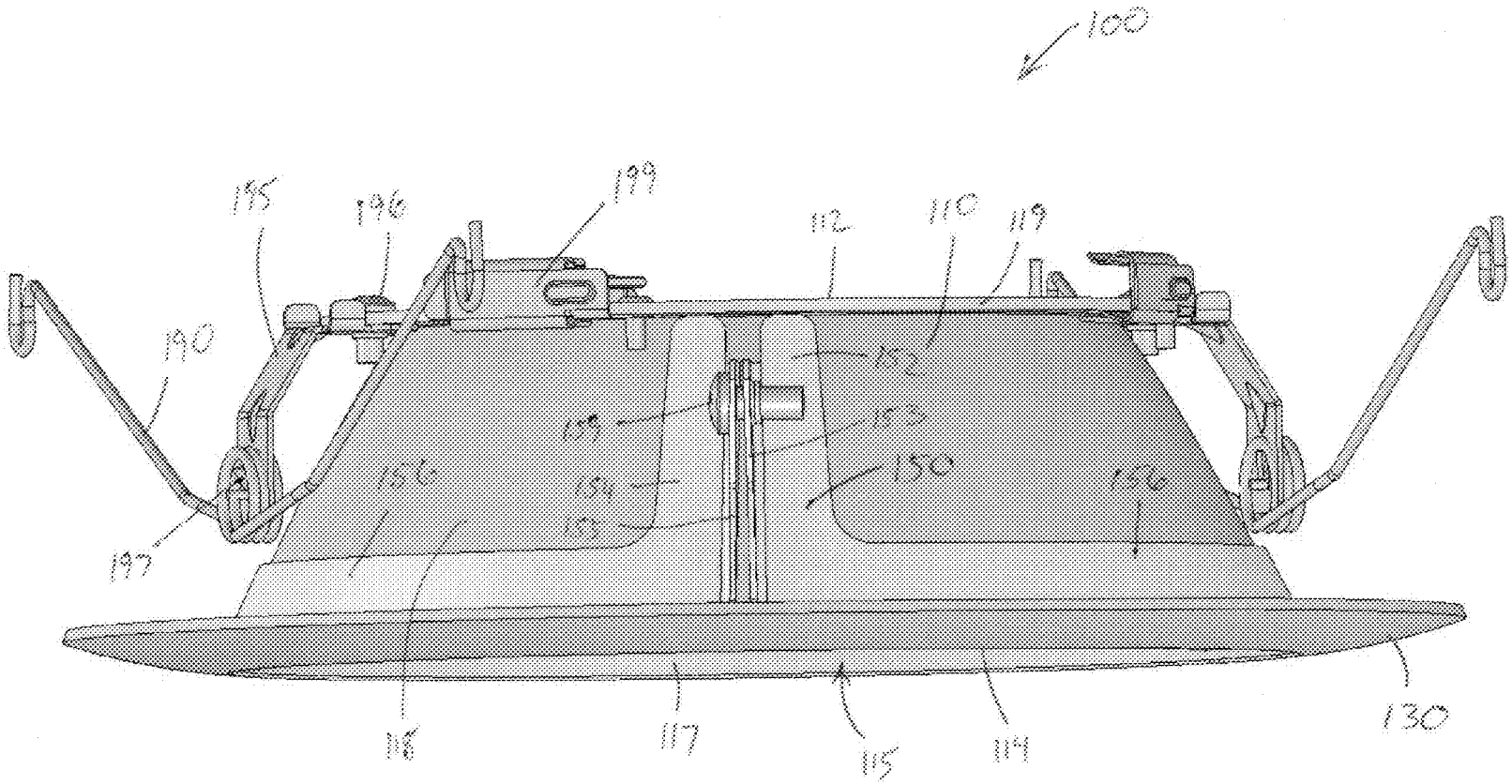
FIG. 3 is a side view of the wall-wash assembly of FIG. 1 in accordance with an exemplary embodiment of the present invention.

The invention is better understood by reading the following description of non-limiting, exemplary embodiments with reference to the attached drawings, wherein like parts of each of the figures are identified by like reference characters, and which are briefly described as follows. FIG. 1 is a perspective view of a wall-wash assembly 100 in accordance with an exemplary embodiment of the present invention. FIG. 2 is a top view of the wall-wash assembly 100 in accordance with an exemplary embodiment of the present invention. FIG. 3 is a side view of the wall-wash assembly 100 in accordance with an exemplary embodiment of the present invention. Referring to FIGS. 1-3, the wall-wash assembly 100 includes a reflector 110, a trim 130, one or more bands 150, and one or more magnetic kicker reflectors 170. According to some exemplary embodiments, the wall-wash assembly 100 also includes a pair of torsion springs 190 that couple the reflector 110 to a fixture housing (not shown).

The reflector 110 is substantially parabolic-shaped and includes a proximal end 112, a distal end 114, and a side surface 116 extending from the proximal end 112 to the distal end 114. The proximal end 112 forms a proximal opening 213 and the distal end 114 forms a distal opening 115. In some exemplary embodiments, the proximal opening 213 and the distal opening 115 are circular or substantially circular in shape. However, the shapes of the openings 213, 115 are modified into different shapes in other exemplary embodiments. According to some exemplary embodiments, the proximal end 112 is positioned adjacent to a lens (not shown) disposed over one or more LED light sources (not shown). Alternatively, the proximal end 112 is positioned adjacent to the one or more LED light sources and surrounds the LED light sources when assembled into the light fixture (not shown), which is known by persons having ordinary skill in the art and is not described in further detail herein. In some exemplary embodiments, the diameter of the proximal opening 213 is less than the diameter of the distal opening 115. However, in alternative exemplary embodiments, the diameter of the proximal opening 213 is equal to or greater than the diameter of the distal opening 115.

The side surface 116 includes an internal surface 117 and an opposing external surface 118. According to some exemplary embodiments, the internal surface 117 is smooth. Alternatively, the internal surface 117 is faceted, dimpled, or uneven in other exemplary embodiments. In some exemplary embodiments, the reflector 110 has a parabolic or elliptical shape; however, other shapes, including but not limited to, conical or any other geometric and non-geometric shapes for the reflector 110, are within the scope and spirit of the exemplary embodiment.

According to some exemplary embodiments, a flange 119 extends radially out from the proximal end 112. The flange 119 provides for a location to couple brackets 195 and clips 199. For example, one or more brackets 195 are coupled to the flange 119 using a fastening device 196, such as a screw, a nail, a snap, a clip, a pin, and/or other fastening device known to a person having ordinary skill in the art. Each of these brackets 195 allow for a respective torsion spring 190 to be coupled thereto. In certain exemplary embodiments, the brackets 195 are spaced apart 180 degrees around the flange 119, but can be spaced apart at different angles in other exemplary embodiments. In another example, one or more clips 199 are coupled to the flange 119. These clips 199 allow for the lens, in certain exemplary embodiments, to be coupled thereto, thereby having a portion of the clip 199 above the lens and a portion of the clip 199 below the flange 119. In certain exemplary embodiments, the clips 199 are spaced apart 120 degrees around the flange 119, but can be spaced apart at different angles in other exemplary embodiments. Additionally, although three clips 199 are shown to be used within the present illustration, greater or fewer clips are used in alternative exemplary embodiments.

In some exemplary embodiments, the reflector 110 is fabricated from an aluminum material, which is not magnetic. However, in other exemplary embodiments, the reflector 110 is fabricated from a plastic material including, but not limited to, polymethylmethacrylate ("PMMA") or polycarbonate. In some exemplary embodiments, at least a portion of the internal surface 117 is fabricated to be reflective. For example, at least a portion of the plastic reflector's internal surface 117 is coated with a metallic material, such as aluminum or stainless steel using a vacuum metalizing process. Other materials that can be used include, but are not limited to, other materials either having or that can be made to have a reflective inner surface, whether the material is magnetic or non-magnetic.

The trim 130 extends radially out from the distal end 114. According to some exemplary embodiments, the trim 130 is integrally formed with the reflector 110 as a single component. Thus, in certain exemplary embodiments, the trim 130 and the reflector 110 are fabricated from the same material. However, in other exemplary embodiments, the trim 130 and the reflector 110 are fabricated as different components and thereafter assembled to one another. Once the fixture is installed within the ceiling, the trim 130 is disposed below and adjacent to the ceiling.

One or more bands 150 are disposed and wrap about the external surface 118 of the reflector 110. In some exemplary embodiments, a plurality of bands 150 are coupled to one another and wrap around the external surface 118 of the reflector's side surface 116. According to some exemplary embodiments, there are two bands 150 that are coupled to one another. Each band 150 extends about half way around the reflector's external surface 118. According to some exemplary embodiments, each band 150 includes a first section 152, a second section 154, and a central section 156 extending from the first section 152 to the second section 154. The band 150 also includes a first mounting section 153 coupled to the first section 152 and a second mounting section 155 coupled to the second section 154 according to certain exemplary embodiments. The first section 152 and the second section 154 extend substantially perpendicular with respect to the central section 156 such that each of the first section 152, the second section 154, and the central section 156 are in contact with the external surface 118 once the band 150 is wrapped around at least a portion of the external surface 118. Hence, the first section 152 and the second section 154 extend along the external surface 118 from substantially the distal end 114 to the proximal end 112 and the central section 156 extends circumferentially about at least a portion of the external surface 118 when the band 150 is wrapped about at least a portion of the external surface 118. In certain exemplary embodiments, the central section 156 extends along the external surface 118 from substantially the distal end 114 towards the proximal end 112. However, in alternative exemplary embodiments, the central section 156 extends from a distance away from the distal end 114 towards the proximal end 112.

The first mounting section 153 extends outward from the first section 152 away from the external surface 118 once the band 150 is wrapped about at least a portion of the external surface 118. Similarly, the second mounting section 155 extends outward from the second section 154 away from the external surface 118 once the band 150 is wrapped about at least a portion of the external surface 118. Each of the first and second mounting sections 153, 155 is formed with an opening 151, which allows for a fastening device 159, such as a screw, to be inserted therein. According to some exemplary embodiments, the opening 151 of one band's second mounting section 155 is aligned with the opening 151 of another band's first mounting section 153, thereby allowing the fastening device 159 to be inserted therethrough. Similarly, the opening 151 of one band's first mounting section 153 is aligned with the opening 151 of another band's second mounting section 155, thereby allowing the fastening device 159 to be inserted therethrough. Although two bands 150 are illustrated as extending circumferentially around the external surface 118, fewer or greater bands are used in other exemplary embodiments. The band 150 is fabricated from steel. However, the band 150 is fabricated from any other suitable material that is capable of or is made to be capable of attracting a magnet in alternative exemplary embodiments.

Torsion springs 190 are coupled to the reflector 110 using brackets 195. However, the torsion springs 190 are coupled to the reflector 110 using other attachment devices that are known to persons having ordinary skill in the art in other exemplary embodiments. Typically, two torsion springs 190 are mounted about 180 degrees from one another, however, a different number of torsion springs 190 can be mounted and at different angles from one another. The mounting bracket 195 also includes a protrusion 197 that facilitates mounting the torsion spring 190 to the reflector 110. Although one method is described for mounting torsion springs 190 to the reflector 110, other methods known to people having ordinary skill in the art can be used for coupling torsion springs to the reflector without departing from the scope and spirit of the exemplary embodiment.

Each torsion spring 190 includes opposing bracket ends 190*a* that are used to couple the reflector 110 to the fixture housing. To install the wall-wash assembly 100 in the fixture housing, the bracket ends 190*a* are squeezed together, the wall-wash assembly 100 is slid into the cavity of the fixture housing, and the bracket ends 190*a* are aligned with the torsion spring receivers (not shown) within the fixture housing and then released such that the bracket ends 190*a* enter the torsion spring receivers.

Figure 4A:
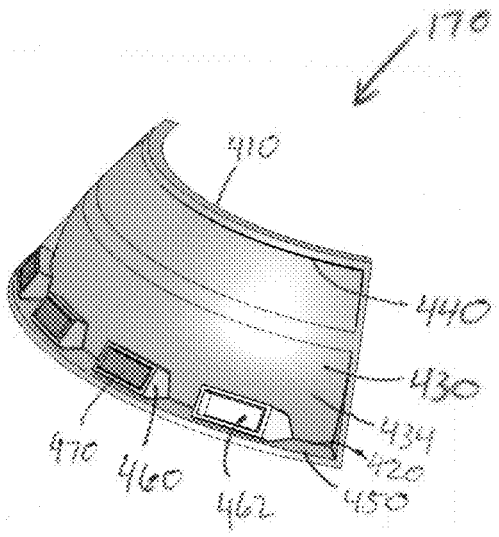
FIG. 4A is a perspective view of a magnetic kicker reflector of FIG. 1 in accordance with an exemplary embodiment of the present invention.
Figure 4B:
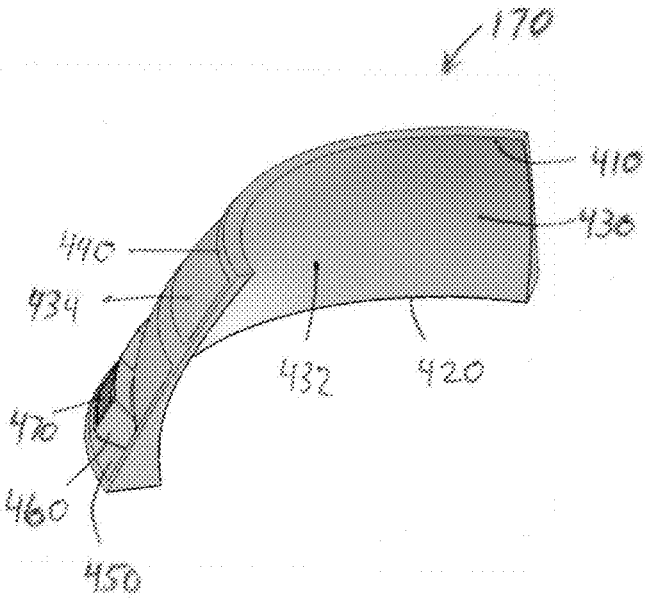
FIG. 4B is another perspective view of the magnetic kicker reflector of FIG. 1 in accordance with an exemplary embodiment of the present invention.

FIG. 4A is a perspective view of the magnetic kicker reflector 170 in accordance with an exemplary embodiment of the present invention. FIG. 4B is another perspective view of the magnetic kicker reflector 170 in accordance with an exemplary embodiment of the present invention. Referring to FIGS. 1-2 and 4A-4B, the magnetic kicker reflector 170 includes a proximal end 410, a distal end 420, a side surface 430 extending from the proximal end 410 to the distal end 420, a proximal flange 440, a distal flange 450, one or more protrusions 460, and one or more magnets 470. The magnetic kicker reflector 170, excluding the magnets 470, is fabricated using a plastic material, but other suitable materials can be used in other exemplary embodiments.

The proximal end 410 is positioned adjacent the reflector's proximal end 112 within the reflector's proximal opening 213 and substantially within the same plane as the reflector's proximal end 112 when the magnetic kicker reflector 170 is coupled to the reflector's internal surface 117. However, in other exemplary embodiments, the proximal end 410 is positioned along the reflector's internal surface 117 at a different plane than the reflector's proximal end 112.

The distal end 420 is positioned adjacent the reflector's distal end 114 within the reflector's distal opening 115 and substantially within the same plane as the reflector's distal end 114 when the magnetic kicker reflector 170 is coupled to the reflector's internal surface 117. However, in other exemplary embodiments, the distal end 420 is positioned along the reflector's internal surface 117 at a different plane than the reflector's distal end 114.

The side surface 430 extends from the proximal end 410 to the distal end 420 and includes an internal surface 432 and an opposing external surface 434, which faces the reflector's internal surface 117 when the magnetic kicker reflector 170 is coupled to the reflector's internal surface 117. At least a portion of the internal surface 432 is fabricated to be reflective. For example, at least a portion of the plastic magnetic kicker reflector's internal surface 432 is coated with a metallic material, such as aluminum or stainless steel using a vacuum metalizing process. In certain exemplary embodiments, the internal surface 432 is has a contour that is different than the contour of the reflector's internal surface 117, thereby emitting light onto an adjacent wall and creating the "wall-wash" effect. The contour of the internal surface 430 is configured such that the upper portion of the internal surface 432 directs light on the adjacent wall extending to the bottom of the adjacent wall, while the lower portion of the internal surface 432 directs light on the adjacent wall extending to the top of the adjacent wall. The external surface 434 is contoured such that at least a portion of the external surface 434 is contoured similarly to the contour of the reflector's internal surface 117. However, in other exemplary embodiments, the contour of the external surface 434 is different than the contour of the reflector's internal surface 117. In certain exemplary embodiments, at least a portion of the external surface 434 is in contact with at least a portion of the reflector's internal surface 117.

The proximal flange 440 extends out from the proximal end 410 towards the reflector's proximal end 112 when the magnetic kicker reflector 170 is coupled to the reflector's internal surface 117. The outer edge of the proximal flange 440 has a radius of curvature that is the similar to the radius of curvature of the reflector's proximal end 112. The proximal flange 440 is positioned within the reflector's proximal opening 213 and substantially within the same plane as the reflector's proximal end 112 when the magnetic kicker reflector 170 is coupled to the reflector's internal surface 117. In certain exemplary embodiments, the outer edge of the proximal flange 440 is positioned adjacent and substantially flush with the reflector's proximal end 112.

The distal flange 450 extends out from the distal end 420 towards the reflector's distal end 114 when the magnetic kicker reflector 170 is coupled to the reflector's internal surface 117. The outer edge of the distal flange 450 has a radius of curvature that is the similar to the radius of curvature of the reflector's distal end 114. The distal flange 450 is positioned within the reflector's distal opening 115 and substantially within the same plane as the reflector's distal end 114 when the magnetic kicker reflector 170 is coupled to the reflector's internal surface 117. In certain exemplary embodiments, the outer edge of the distal flange 450 is positioned adjacent and substantially flush with the reflector's distal end 114.

One or more protrusions 460 are molded to extend out from substantially the distal end 420 and are positioned between the distal flange 450 and a portion of the side surface 430. The protrusions 460 extend toward the reflector's internal surface 117 when the magnetic kicker reflector 170 is coupled to the reflector's internal surface 117. Each protrusion 460 defines a cavity 462 therein. The cavity 462 is rectangular shaped but is shaped differently in other exemplary embodiments. Further, in certain exemplary embodiments, one or more protrusions 460 extend outwardly from either the external surface 434 or the distal flange 450.

Each magnet 470 is inserted within the cavity 462 of the respective protrusion 460 and is coupled therein using glue or epoxy adhesive (not shown). The magnet 470 is rectangular shaped, but is shaped differently pursuant to the shape of the cavity 462. The magnets 470 are in contact with the reflector's internal surface 117 when the magnetic kicker reflector 170 is coupled to the reflector's internal surface 117. Thus, at least a portion of the distal flange 450, a portion of the magnets 470, and a portion of the proximal flange 440 are in contact with the reflector's internal surface 117, or are in accordance with the contours of the reflector's internal surface 117, when the magnetic kicker reflector 170 is coupled to the reflector's internal surface 117. According to some exemplary embodiments, the magnets 470 are rare earth magnets, such as neodymium magnets or samarium-cobalt magnets. In some of these exemplary embodiments, the magnets 470 are nickel plated to protect them against corrosion and breakage. However, in other exemplary embodiments, the magnets 470 are made from other ferromagnetic materials, such as iron, nickel, and cobalt. Although the protrusions 460 and the magnets 470 are aligned at about the same elevation, one or more protrusions 460 and magnets 470 are aligned at a different elevation in other exemplary embodiments.

The magnetic kicker reflector 170 extends a 120 degree arcuate curve length in accordance with some exemplary embodiments. However, in other exemplary embodiments, the magnetic kicker reflector 170 extends greater than or less than 120 degree arcuate curve length. Yet, in other exemplary embodiments, two or more magnetic kicker reflectors 170 are combined to form the desired arcuate curve length, which is 120 degrees in certain exemplary embodiments.

The installation of the magnetic kicker reflector 170 to the reflector 110 is ascertainable while referencing FIGS. 1-2 and 4A-4B. Referring to FIGS. 1-2 and 4A-4B, the proximal end 410 of the magnetic kicker reflector 170 is inserted through the reflector's distal opening 115 and moved towards the reflector's proximal opening 213. Once the magnetic kicker reflector's proximal end 410 is substantially aligned with the reflector's proximal end 112 and the magnetic kicker reflector's distal end 420 is substantially aligned with the reflector's distal end 114, the magnetic kicker reflector's external surface 434 is placed into contact with the reflector's internal surface 117. The magnets 470 are positioned in alignment with the band's central section 156 and is attracted to the band 150. This attraction between the magnets 470 and the band 150 securely positions the magnetic kicker reflector 170 within the reflector 110. The magnetic kicker reflector 170 is now rotatable within the reflector 110 along the reflector's internal surface 117 and the magnets 470 move along the central section 156 of one or more bands 150. The magnetic kicker reflector 170 is positioned to emit light onto an adjacent wall and create a "wall-wash" effect.

Figure 5:
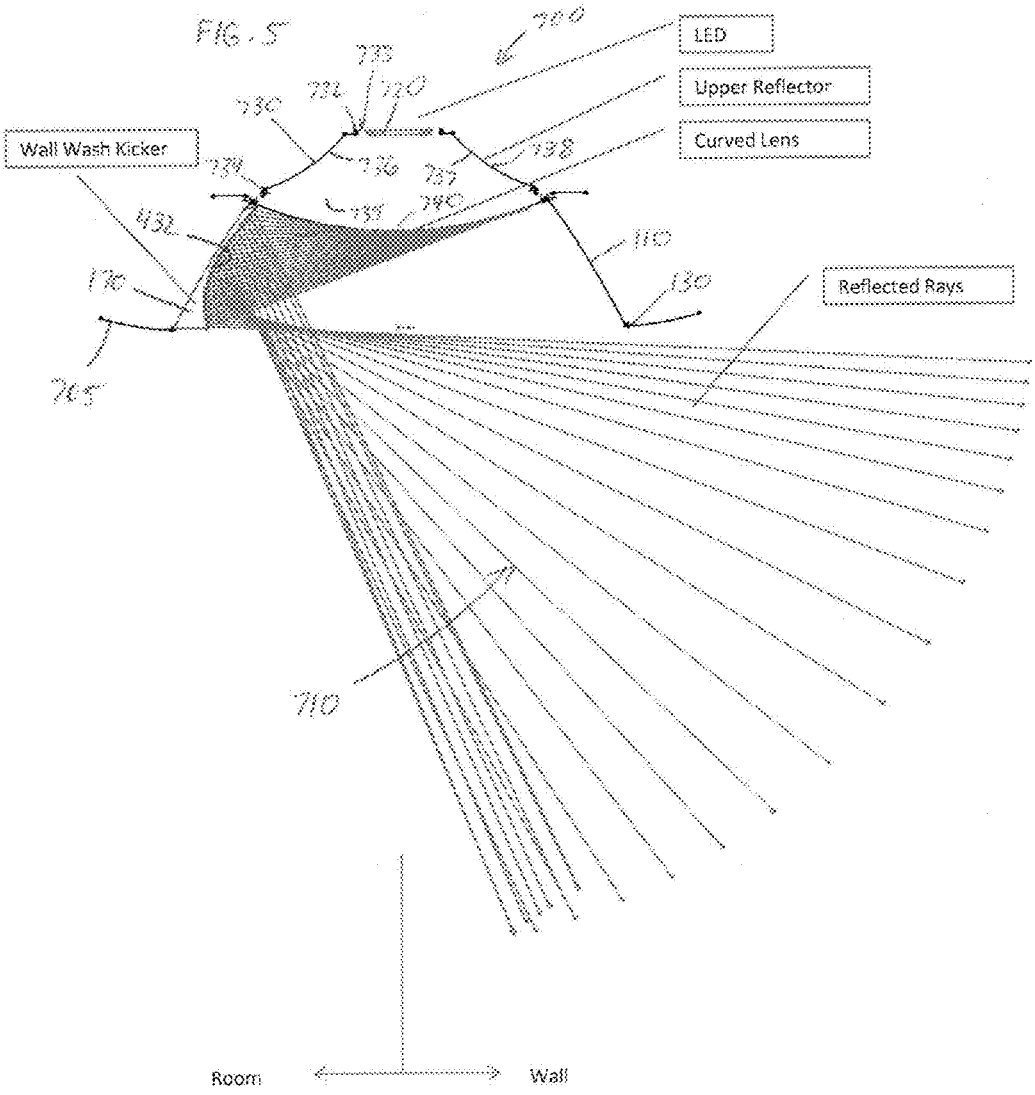
FIG. 5 is a schematic view of a downlight wall-wash lighting fixture showing paths of light formed by the downlight wall-wash lighting fixture in accordance with an exemplary embodiment of the present invention.

FIG. 5 is a schematic view of a downlight wall-wash lighting fixture 700 showing paths of light 710 formed by the downlight wall-wash lighting fixture 700 in accordance with an exemplary embodiment of the present invention. Referring to FIG. 5, the downlight wall-wash lighting fixture 700 includes a light source 720, an upper reflector 730, a lens 740, and the wall-wash assembly 100.

The light source 720 includes one or more LEDs, or LED die packages (referred to collectively hereinafter as "LEDs"). One or more LEDs are disposed on and/or electrically coupled to a substrate (not shown) and are configured to emit light. Each LED includes at least one chip of semi-conductive material that is treated to create a positive-negative ("p-n") junction. When the LED or LED die package is electrically coupled to a power source, such as a driver (not shown), current flows from the positive side to the negative side of each junction, causing charge carriers to release energy in the form of incoherent light. According to some exemplary embodiments, the LEDs are aligned on the substrate in an array, but can be aligned differently in other exemplary embodiments.

The wavelength or color of the emitted light depends on the materials used to make the LED. For example, a blue or ultraviolet LED can include gallium nitride ("GaN") or indium gallium nitride ("InGaN"), a red LED can include aluminum gallium arsenide ("AlGaAs"), and a green LED can include aluminum gallium phosphide ("AlGaP"). Each of the LEDs in the LED package can produce the same or a distinct color of light. For example, the LED package can include one or more white LED's and one or more non-white LEDs, such as red, yellow, amber, or blue LEDs, for adjusting the color temperature output of the light emitted. In certain exemplary embodiments, a yellow or multi-chromatic phosphor coats, or otherwise is used in, a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the LEDs in the LED package has a color temperature between 2500 and 6000 degrees Kelvin.

In certain exemplary embodiments, an optically transmissive or clear material (not shown) encapsulates at least a portion of each LED. This encapsulating material provides environmental protection while transmitting light from the LEDs. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light. In some exemplary embodiments, each of the LEDs emits white or substantially white light. However, one or more LEDs emit non-white light in other exemplary embodiments.

The upper reflector 730 is substantially parabolic-shaped and includes a proximal end 732, a distal end 734, and a side surface 736 extending from the proximal end 732 to the distal end 734. The proximal end 732 forms a proximal opening 733 and the distal end 734 forms a distal opening 735. In some exemplary embodiments, the proximal opening 733 and the distal opening 735 are circular or substantially circular in shape. However, the shapes of the openings 733, 735 are modified into different shapes in other exemplary embodiments. According to some exemplary embodiments, the proximal end 732 is positioned adjacent to the one or more LED light sources 720 and surrounds the LED light sources 720 when assembled into the downlight wall-wash lighting fixture 700. In some exemplary embodiments, the diameter of the proximal opening 733 is less than the diameter of the distal opening 735. However, in alternative exemplary embodiments, the diameter of the proximal opening 733 is equal to or greater than the diameter of the distal opening 735.

The side surface 736 includes an internal surface 737 and an opposing external surface 738. According to some exemplary embodiments, the internal surface 737 is smooth. Alternatively, the internal surface 737 is faceted, dimpled, or uneven in other exemplary embodiments. In some exemplary embodiments, the upper reflector 730 has a parabolic or elliptical shape; however, other shapes, including but not limited to, conical or any other geometric and non-geometric shapes for the upper reflector 730, are within the scope and spirit of the exemplary embodiment.

The wall-wash assembly 100 has been described in detail with respect to FIGS. 1-4B and therefore is not repeated again for the sake of brevity. As previously mentioned, the wall-wash assembly 100 includes at least a reflector 110, a trim 130, one or more bands 150 (FIG. 1), and one or more magnetic kicker reflectors 170.

The lens 740 is coupled to the wall-wash assembly 100 at the proximal end 112 using one or more clips 199 (FIG. 1), which was previously described above, according to some exemplary embodiments. However, in other exemplary embodiments, the lens 740 is coupled to the upper reflector 730 either within it or substantially at the distal end 734. Thus, the lens 740 is disposed substantially between the LED light source 720 and the reflector 110. The lens 740 is curve shaped in some exemplary embodiments, while in others, the lens 740 is a different shape, such as planar. The lens 740 is fabricated using acrylic or other plastic materials and is either transparent or translucent. However, in other exemplary embodiments, the lens 740 is fabricated using other suitable materials, such as glass. Additionally, in some exemplary embodiments, the lens 749 is substantially smooth, while in other exemplary embodiments, the lens 740 is faceted or includes one or more prismatic elements, such as dimples, formed therein.

The downlight wall-wash lighting fixture 700 is installed within a ceiling 705 near at least one adjacent wall (not shown). The magnetic kicker reflector 170 is positioned furthest away from the adjacent wall such that the internal surface 432 faces in the direction of the adjacent wall. The LED light source 720 emits light towards the lens 740, which then emits light into the reflector 110. A portion of the emitted light is directed to the internal surface 432 of the magnetic kicker reflector 170, which is then reflected as reflected rays 710 towards the adjacent wall, thereby providing the "wall-wash" effect on the adjacent wall. As previously mentioned and as illustrated in FIG. 5, the upper portion of the magnetic kicker reflector's internal surface 432 directs light on the adjacent wall extending to the bottom of the adjacent wall, while the lower portion of the magnetic kicker reflector's internal surface 432 directs light on the adjacent wall extending substantially to the top of the adjacent wall. In the event that the user desires to change the adjacent wall which receives the "wall-wash" effect, the user rotates the magnetic kicker reflector 170 within the reflector 170 until the "wall-wash" effect is produced on the desired adjacent wall. For example, if the user desires to change the "wall-wash" effect from one adjacent wall to another adjacent wall that is perpendicular to the previous adjacent wall, the user rotates the magnetic kicker reflector 170 within the reflector 170 about ninety degrees. In another example, if the user desires to change the "wall-wash" effect from one adjacent wall to another adjacent wall that is parallel to the previous adjacent wall, such as a hallway, the user rotates the magnetic kicker reflector 170 within the reflector 170 about 180 degrees.

Although one magnetic kicker reflector 170 is positioned within and coupled to the reflector 110, additional magnetic kicker reflectors 170 are positioned within and coupled to the reflector 110 to provide simultaneous "wall-wash" effects on different adjacent walls. Alternatively, the magnetic kicker reflector 170 is removable from the reflector 110 so that light is emitted from the fixture 700 without generating "wash-wash" effects on any adjacent wall.

According to some exemplary embodiments, one or more components are provided in a wall-wash kit assembly to be used with pre-existing light fixtures, such as pre-existing recessed downlight fixtures that include a pre-existing reflector. In some exemplary embodiments, the wall-wash kit assembly includes at least one magnetic kicker reflector 170 that is to be inserted within and coupled to the internal surface of the pre-existing reflector. In other exemplary embodiments, the wall-wash kit assembly includes at least one magnetic kicker reflector 170, at least one band 150, and at least one fastening device 159. Each magnetic kicker reflector 170 is insertable within and coupleable to the internal surface of the pre-existing reflector. Each band 150 is wrapped about at least a portion of the external surface of the pre-existing reflector. The fastening devices 159 are used to couple one band 150 to another band 150. Although certain components are included within the wall-wash kit assembly, greater or fewer components of the wall-wash assembly 100 are included within the wall-wash kit assembly in other exemplary embodiments. Additionally, some components are provided in a disassembled condition. For example, the magnets 470 are provided separate from the magnetic kicker reflector 170 in the wall-wash kit assembly and are to be coupled thereto prior to installing the magnetic kicker reflector 170 within the pre-existing reflector.

Figure 6:
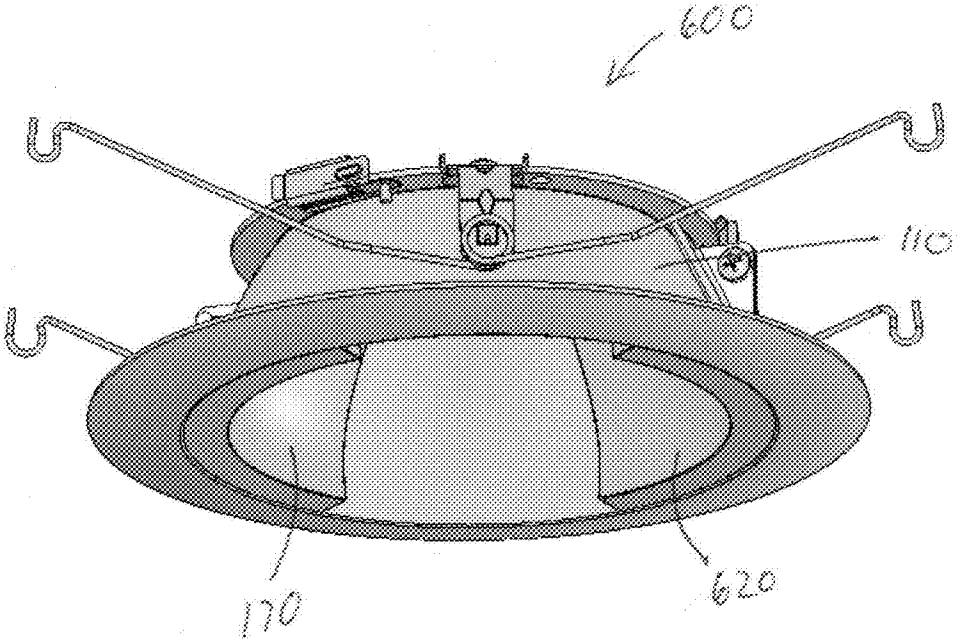
FIG. 6 is a perspective view of a wall-wash assembly in accordance with another exemplary embodiment of the present invention.

FIG. 6 is a perspective view of a wall-wash assembly 600 in accordance with another exemplary embodiment of the present invention. The wall-wash assembly 600 is similar to the wall-wash assembly 100 (FIG. 1), except that a second magnetic kicker reflector 620 is positioned within and coupled to the reflector 110. The second magnetic kicker reflector 620 is similar to the magnetic kicker reflector 170 and is positioned within the reflector 110 facing the magnetic kicker reflector 170. Thus, the second magnetic kicker reflector 620 and the magnetic kicker reflector 170 are oriented about 180 degrees apart. The wall-wash assembly 600 is used to provide simultaneous "wall-wash" effects on parallel adjacent walls facing one another, such as in a hallway. Any one or both of these magnetic kicker reflector 170 and second magnetic kicker reflector 620 are rotatable or removable to modify the "wall-washing" effects.

Figure 7:
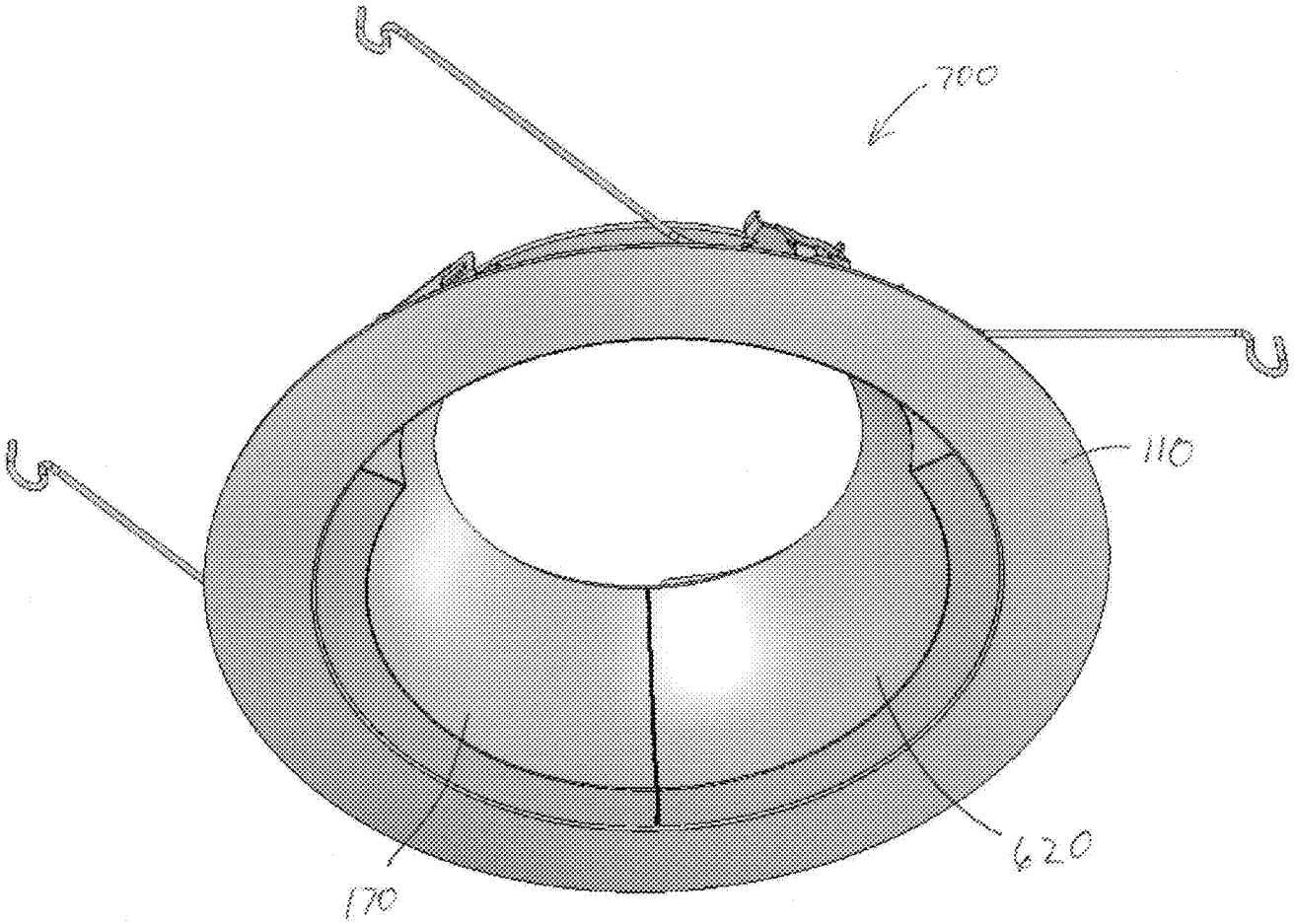
FIG. 7 is a perspective view of a wall-wash assembly in accordance with yet another exemplary embodiment of the present invention.

FIG. 7 is a perspective view of a wall-wash assembly 700 in accordance with yet another exemplary embodiment of the present invention. The wall-wash assembly 700 is similar to the wall-wash assembly 100 (FIG. 1), except that a second magnetic kicker reflector 620 is positioned within and coupled to the reflector 110. The second magnetic kicker reflector 620 is similar to the magnetic kicker reflector 170 and is positioned within the reflector 110 adjacent to the magnetic kicker reflector 170. Thus, the second magnetic kicker reflector 620 and the magnetic kicker reflector 170 collectively extend two-thirds, or 120 degrees around the reflector 110. However, in other exemplary embodiments and depending upon the arcuate length of the magnetic kicker reflectors 170, 620, the second magnetic kicker reflector 620 and the magnetic kicker reflector 170 collectively extend greater than or less than two-thirds, or 120 degrees around the reflector 110. The wall-wash assembly 700 is used to provide simultaneous "wall-wash" effects on perpendicular adjacent walls, such as in a corner of a room. Any one or both of these magnetic kicker reflector 170 and second magnetic kicker reflector 620 are rotatable or removable to modify the "wall-washing" effects.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A magnetic reflector, comprising:
- a proximal end;
- a distal end;
- a side portion comprising an internal surface and an opposing external surface, the side portion extending from the proximal end to the distal end;
- one or more magnets coupled to the external surface and facing substantially a same direction as the external surface,
- wherein an internal contour of the internal surface is different than an external contour of the external surface, and wherein the proximal end, the distal end, and the side portion comprise an arcuate curve length;
- a distal flange extending radially out from the distal end; and
- one or more protrusions extending out from at least one of the distal flange and the external surface, each protrusion forming a cavity therein, wherein each magnet is coupled to the corresponding protrusion within the cavity.

2. The magnetic reflector of claim 1, wherein the arcuate curve length is about 120 degrees.

3. The magnetic reflector of claim 1, wherein one or more magnets are arranged in a linear array.

4. The magnetic reflector of claim 1, wherein the internal surface is reflective.

5. The magnetic reflector of claim 1, wherein at least one of magnet of the one or more magnets comprises a surface, wherein at least a portion of the surface of the at least one magnet faces substantially the same direction as the external surface.

6. A wall-wash assembly, comprising:
- a reflector comprising:
  - a proximal end forming a proximal opening;
  - a distal end forming a distal opening; and
  - a side portion comprising an internal surface and an opposing external surface, the side portion extending from the proximal end to the distal end;
- at least one band disposed about and in contact with the external surface, the at least one band extending around a circumference of at least a portion of the external surface; and
- at least one magnetic kicker reflector disposed within the reflector and positioned adjacent to at least a portion of the internal surface, the magnetic kicker reflector comprising:
  - a kicker proximal end;
  - a kicker distal end;
  - a kicker side portion comprising a kicker internal surface and an opposing kicker external surface, the kicker side portion extending from the kicker proximal end to the kicker distal end;
  - one or more magnets coupled to the kicker external surface and in contact with the internal surface of the reflector, the one or more magnets being aligned and attracted to at least a portion of the band, wherein an internal contour of the kicker internal surface is different than the an external contour of the external surface of the reflector, and wherein the kicker proximal end, the kicker distal end, and the kicker side portion comprise an arcuate curve length;
  - a distal flange extending radially out from the kicker distal end; and
  - one or more protrusions extending out from at least one of the distal flange and the kicker external surface, each protrusion forming a cavity therein, wherein each magnet is coupled to the corresponding protrusion within the cavity.

7. The wall-wash assembly of claim 6, wherein the magnetic kicker reflector is rotatable from a first position to a second position within the reflector.

8. The wall-wash assembly of claim 6, wherein the at least one magnetic kicker reflector comprises a plurality of magnetic kicker reflectors, at least one magnetic kicker reflector positioned adjacent to a second magnetic kicker reflector within the reflector.

9. The wall-wash assembly of claim 6, wherein the at least one magnetic kicker reflector comprises a plurality of magnetic kicker reflectors, at least one magnetic kicker reflector positioned about 180 degrees apart from and facing a second magnetic kicker reflector within the reflector.

10. The wall-wash assembly of claim 6, further comprising a lens, the lens being coupled to the reflector at the proximal end of the reflector and disposed over the proximal opening.

11. The wall-wash assembly of claim 6, wherein each band extends along a substantially arcuate linear path along at least a portion of the circumference of the external surface of the reflector.

12. The wall-wash assembly of claim 6, wherein the arcuate curve length is about 120 degrees.

13. The wall-wash assembly of claim 6, wherein the one or more magnets are arranged in a linear array.

14. A wall-wash kit assembly, comprising:

a magnetic kicker reflector comprising:

a proximal end;

a distal end;

a side portion comprising an internal surface and an opposing external surface, the side portion extending from the proximal end to the distal end;

one or more magnets to be coupled to the external surface and to face substantially the same direction as the external surface, wherein the proximal end, the distal end, and the side portion comprise an arcuate curve length;

a distal flange extending radially out from the distal end; and one or more protrusions extending out from at least one of the distal flange and the external surface, each protrusion forming a cavity therein to receive the corresponding magnet.

15. The wall-wash kit assembly of claim 14, further comprising at least one band fabricated from a material, the one or more magnets being magnetically attracted to the band.

16. The wall-wash kit assembly of claim 14, wherein at least one magnet of the one or more magnets comprises a surface, wherein at least a portion of the surface of the at least one magnet faces substantially the same direction as the external surface.

* * * * *